United States Patent [19]

James et al.

[11] Patent Number: 4,578,620

[45] Date of Patent: Mar. 25, 1986

[54] SLOW WAVE CIRCUIT FOR A TRAVELING WAVE TUBE

[75] Inventors: Bertram G. James, Redwood City; Frank C. Dinapoli, Saratoga; Lloyd P. Hayes, San Jose, all of Calif.

[73] Assignee: Varian Associates, Inc., Palo Alto, Calif.

[21] Appl. No.: 626,467

[22] Filed: Jun. 29, 1984

Related U.S. Application Data

[63] Continuation of Ser. No. 371,368, Apr. 23, 1982, abandoned.

[51] Int. Cl.[4] ..... H01J 25/36

[52] U.S. Cl. ..... 315/3.5; 315/39.3; 333/156

[58] Field of Search ..... 333/156, 157; 315/3.5, 315/3.6, 39.3, 39 TW; 331/82; 330/43

[56] References Cited

U.S. PATENT DOCUMENTS

| | | | |
|---|---|---|---|
| 2,942,142 | 6/1960 | Dench | 315/3.5 |
| 3,505,730 | 4/1970 | Nelson | 29/600 |
| 4,409,518 | 10/1983 | Karp et al. | 315/3.6 X |
| 4,409,519 | 10/1983 | Karp | 315/39.3 |

*Primary Examiner*—Eugene R. LaRoche
*Assistant Examiner*—Benny T. Lee
*Attorney, Agent, or Firm*—Stanley Z. Cole; Peter J. Sgarbossa; Richard B. Nelson

[57] ABSTRACT

A coupled-cavity slow-wave circuit for a millimeter-wave TWT is formed by forming cavities through a metallic bar or half-cavities in a pair of comb-shaped bars. The ends of the cavities are covered by cover members, one of which has a longitudinal groove to form "in line" coupling apertures between cavities.

5 Claims, 7 Drawing Figures

FIG. 1A
PRIOR ART
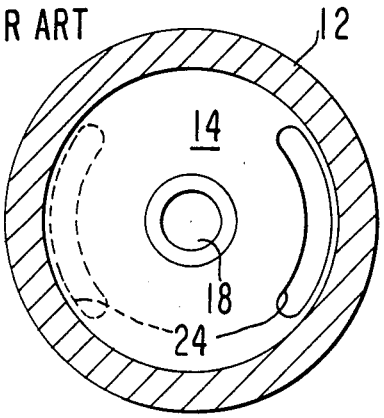
FIG. 1B
PRIOR ART
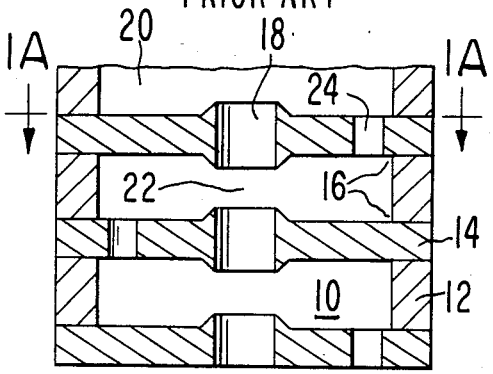
FIG. 2
PRIOR ART
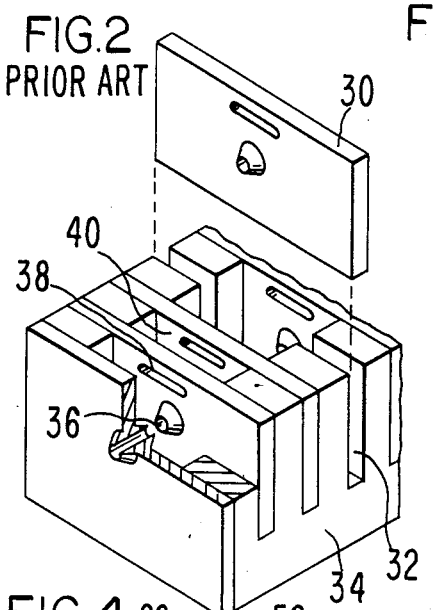
FIG. 3
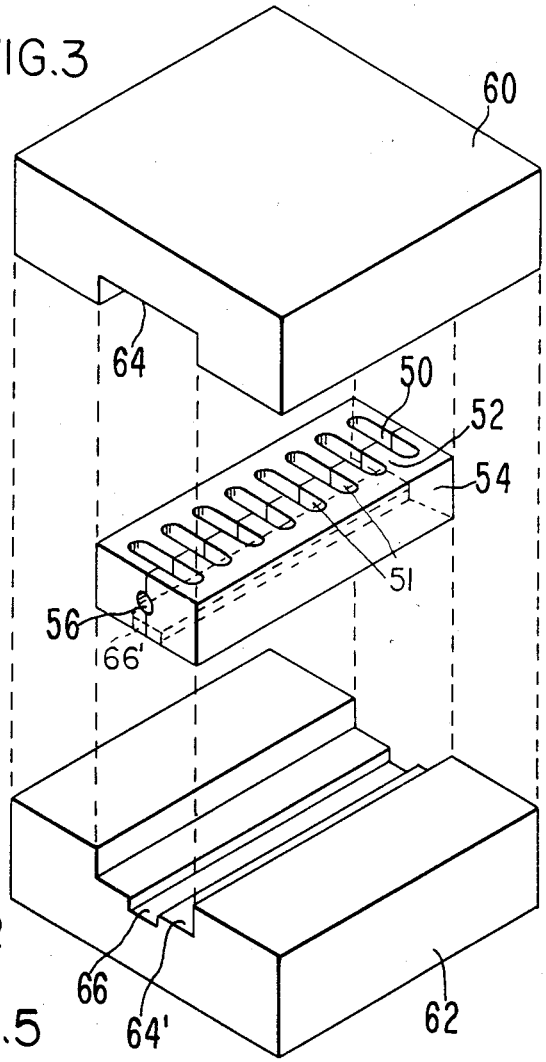
FIG. 4
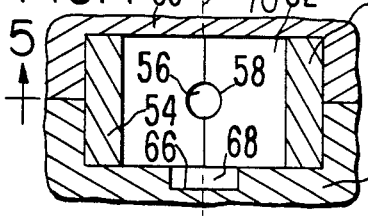
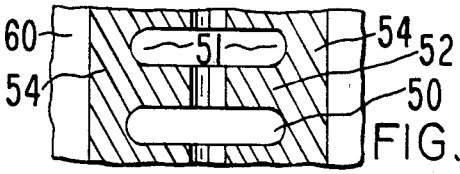
FIG. 5

SLOW WAVE CIRCUIT FOR A TRAVELING WAVE TUBE

This application is a continuation of application Ser. No. 371,368, l filed Apr. 23, 1982, now abandoned.

FIELD OF THE INVENTION

The invention pertains to traveling wave tubes for operation at very high frequencies such as millimeter wavelengths, with relatively high power output. At these frequencies the slow-wave circuits become very small. In making and assembling them, dimensional tolerance errors can lead to severe troubles, particularly if they are cumulative. Also, the tiny assemblies have problems of inadequate thermal and electrical conductivity.

BRIEF DESCRIPTION OF THE DRAWINGS

FIG. 1A is a schematic section of a prior-art coupled-cavity slow wave circuit.

FIG. 1B is an axial section of the circuit of FIG. 1A.

FIG. 2 is a perspective view of an improved prior-art circuit.

FIG. 3 is an exploded perspective view of a slow-wave circuit embodying the invention.

FIG. 4 is a cross-section perpendicular to the beam axis of a circuit similar to that of FIG. 3.

FIG. 5 is an axial section of the circuit of FIG. 4.

PRIOR ART

Figure 6:
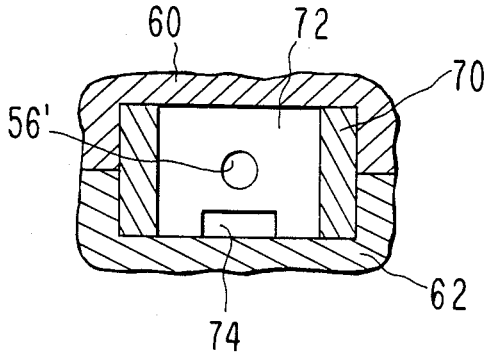
FIG. 6 is a cross-section perpendicular to the beam axis for an alternate embodiment.

For high power, traveling wave tubes (TWT's) have generally used a slow-wave circuit of the "folded waveguide" or "coupled cavity" type. The coupled-cavity slow-wave circuit has been widely used in high-power TWTs of moderate bandwidth. At low frequencies, such as below 20 GHz, a typical construction of such a circuit is illustrated by FIGS. 1. The interaction cavities 10 are formed by spacer rings 12 as of copper, stacked alternating with end plates 14, also copper. The assembly is bonded together by brazing at joints 16 with a silver-copper or gold-copper alloy to form a vacuum tight envelope. Each plate 14 has an axial aperture 18 for passage of an electron beam (not shown) which interacts with the axial component of the rf electric field in the cavities. Aperture 18 is often lengthened axially by protruding lips 20 which confine the electric field to a shorter axial gap 22, thereby raising the interaction impedance and beam coupling factor of the cavity. Adjacent cavities 10 are mutually coupled by a coupling slot 24 in each end plate 14, located near the outer edge of cavity 10 where the rf magnetic field is highest, thus providing coupling by mutual inductance. Alternate coupling slots 24 are staggered on opposite sides of cavities 10. This provides the "folded waveguide" characteristic which provides a large interaction bandwidth. With this type of coupling, the fundamental circuit wave is a backward wave. The tube is operated in the first space-harmonic wave mode, which is a forward wave so that near-synchronous interaction with a constant-velocity electron beam can be achieved over a relatively wide band of frequencies.

The prior-art circuit of FIGS. 1 is satisfactory at low frequencies. However, when built for frequencies such as 20 GHz and higher, it develops serious difficulties. The many parts are tiny and costly to machine accurately. The axial spacing is subject to cumulative errors in stacking. When the stacking errors are in the periodic spacing of elements 14, they deteriorate the bandpass characteristic and impedance of the circuit. When there are errors of alignment on the axis, they can cause beam interception with consequent power loss or tube failure.

Also, the brazed joints 16 can cause two kinds of trouble. If the braze alloy does not flow completely, there is a crack which can present a high resistance to the circulating cavity current which must cross the crack. On the other hand, if the braze alloy flows out on the cavity inside surface, the high electrical resistance of common braze alloys increases the attenuation of the circuit. If the alloy forms a fillet across the corner, the cavity volume is decreased, thereby detuning the cavity resonance and impairing circuit impedance and bandwidth. Thus, if said joints cannot be avoided altogether, at least one should reduce their number and length and locate them where circulating current crossing them is small.

FIG. 2 is a schematic perspective view of a coupled-cavity circuit suitable for high frequency TWT's which eliminates some of the mechanical problems of the circuit of FIG. 1. This circuit is described in U.S. Pat. No. 3,711,943 issued Jan. 23, 1973 to Bertram G. James. The cavities are formed by inserting metallic plates 30 into slots 32 milled into a metallic channel 34. Each plate 30 has a central hole 36 for passing the electron beam and a coupling slot 38 for electromagnetic coupling between adjacent cavities 40. Coupling slots 38 are all aligned on the same side of plates 30, the so-called "in-line" configuration. This configuration gives a somewhat different wave-transmission characteristic from the "staggered" slots of FIG. 1. Plates 30 are brazed to channel 34 and the vacuum envelope is completed by brazing on a metallic cover-plate (not shown).

The circuit of FIG. 2 has the advantage that the periodic spacing of cavities 40 is determined by the positions of slots 32 which may be accurately machined. Thus cumulative errors due to stacking parts as in FIG. 1 are greatly reduced. Some problems remain, however. A large number of joints must be brazed vacuum-tight. Also the braze alloy may form fillets at the corners of cavities 40, changing their volume and resonant frequencies. Also braze alloys have high electrical resistance so the microwave surface currents create unwanted power loss.

SUMMARY OF THE INVENTION

An object of the invention is to provide a TWT slow-wave circuit suitable for millimeter waves having improved mechanical accuracy.

A further object is to provide a circuit having lower electrical losses.

A further object is to provide a circuit which is easy to fabricate.

These objects are fulfilled by a circuit comprising at least one comb-like member, each of these member(s) fabricated from a single piece of matel which is captured within a pair of channel members which are sealed together to form the vacuum envelope. In-line coupling is provided by one or more additional grooves in one of the channel members.

DESCRIPTION OF THE PREFERRED EMBODIMENTS

In FIG. 3, the cavities 50 are formed by a periodic array of openings or slots 51 between the complementary opposed vanes 52 of a pair of unitary comb elements 54. Slots 51 are machined into comb 54 and thus may be spaced with great accuracy and without cumulative error inherent in an axially stacked set of parts as in FIG. 1. Slots 51 have rounded corners, as may also be seen in FIG. 3. Alternatively, the slots may have slightly less efficient rectangular bottoms. The two combs 54 are axially aligned so that teeth or vanes 52 meet precisely. In each comb a semicircular groove 58 (see FIG. 4) is machined in the end of vanes 52 (preferably before cavity slots 51 are machined). Upon assembly of the combs, a line of holes 56 at the center of cavities 50 is then formed. These holes define a series of closed passageways which together define the electron beam pathway. Combs 54 are of oxygen-free high-conductivity copper. Slots 51 may be formed by conventional cutting or by electrical discharge machining. The ends of vanes 52 are joined to their opposite counterparts before or during final assembly of the circuit, as described below. Cavities 50 are made symmetrical with respect to the plane of the tips of vanes 52 so that in operation no rf current or heat flow crosses that plane. Thus a perfect contact is not necessary.

The cavities 50 are completed by enclosing comb structures 54 within a pair of cover or envelope members 60, 62. Member 60 has a relatively wide channel 64 cut to complement the shape of combs 54. Upon assembly, member 60 will then fit tightly over combs 54. Member 62 has a similar wide channel 64' and in addition a narrower central groove or channel 66 which leaves spaces 68 between combs 54 and envelope channel 66. Lined-up spaces 68 form the inter-cavity coupling irises which make the array of cavities into a propagating band-pass slow-wave circuit.

In assembling the circuit, cover members 60, 62 are brought together to tightly enclose combs 54 and are joined together as by brazing or sintering to form the vacuum envelope. In the same operation, members 60, 62 are joined as by sintering or brazing to combs 54 to form the end walls of cavities 50. These walls also serve to conduct heat efficiently from combs 54. The joining plane 70 (see FIG. 4) of channels 60, 62 is preferably a plane of symmetry about the axis, so that no rf cavity current flows across the joint. Preferably the channels 64 and 64' also are of complementary shape with respect to each other such that they are generally symmetrical with respect to the plane of the tips of vanes 52. The various joints in the structure are formed by brazing as with silver-copper eutectic or a gold-copper alloy. Alternatively the joining surfaces may be electroplated with gold or silver to form the alloy at exactly the right places when heated. A preferred method for very high frequencies is to sinter the copper parts together under externally applied pressure at a temperature somewhat below the melting point. With this method there is no high-resistivity alloy at all. A compromise method is to plate the contact surfaces with gold and sinter together at a temperature below the melting point of gold (there is no gold-copper eutectic). With this method there can be no liquid alloy to flow out to undesired areas.

Many other embodiments will be obvious to those skilled in the art. The pair of combs 54 may be replaced by a unitary slab or bar 70, FIG 6 with complete cavity holes 72 drilled through it and the beam hole 56' drilled through the entire slab. (Drilling a long, straight hole is very difficult, however.) The cover members 60, 62 may not necessarily define symmetrical channels; one member could be a flat slab (but the symmetrical arrangement is better as described above). For greater coupling, a second coupling groove similar to groove 66 may also be cut in cover member 60. Also the axial coupling groove or grooves need not be defined in the cover members, but instead could be defined in combs 54 as shown in phantom at 66 in FIG. 3, or in the alternate unitary capacity bar. Such an embodiment would have the advantage of allowing both cover members to be identical in configuration, and also provide superior cavity coupling in certain applications, since the rf pathway between adjacent cavities would be shorter. The embodiments described above are exemplary and not limiting. The scope of the invention is to be limited only by the following claims and their legal equivalents.

What is claimed is:

1. A coupled-cavity slow-wave circuit comprising:

a first one-piece metallic comb having a first pair of opposed limiting surfaces lying on a pair or parallel side planes, an axis aligned midway between said side planes, said comb further including a generally rectangular elongated backing member extending along the direction of said axis and perpendicular to said side planes, an array of identical vanes of generally rectangular shape, each said vane extending at right angles from said backing member and evenly spaced along said axis, said vanes being of equal length and each terminating in an end forming a rectangular tip, each said rectangular tip of said vanes lying in a symmetry plane containing said axis and perpendicular to said side planes, a groove being formed on each said rectangular tip of said vanes and centered along said axis, said vanes, backing member and opposed limiting surfaces defining therebetween an array of slots;

a second one-pice metallic comb having vanes, a backing member, a groove, slots, and a pair of opposed limiting surfaces which are the mirror image of said vanes, backing member, groove, slots and opposed limiting surfaces of said first comb as mirrored in said symmetry plane;

said first and second combs being aligned on said symmetry plane such that said vane grooves align to form an enclosed electron beam passageway, said a pair of opposed limiting surfaces of said second comb lying on said pair of parallel side planes of said first comb, and said slots align to form an array of openings extending through said pair of opposed limiting surfaces;

a pair of metallic cover members, each having a flat surface, said flat surface of each cover member covering and in electrical contact with a respective one of the pair of opposed limiting surfaces of said combs;

at least one of said cover members having a uniform axial channel disposed in said flat surface;

said cover members being bonded to said combs in electrical contact therewith to partially cover and short circuit said openings to form an array of coupled cavities and to form part of a vacuum envelope foe said circuit.

2. The coupled-cavity slow-wave circuit of claim 1 wherein said bond is a sintered connection.

3. The coupled-cavity slow-wave circuit of claim 1 wherein at least one of said cover members has, in addition to said flat surface, side extending beyond said flat surface perpendicular to said flat surface to fit around said backing member of said combs and form a cover around said combs.

4. A coupled-cavity slow-wave circuit comprising:

a first one-piece metallic comb having a first pair of opposed limiting surfaces lying on a pair of parallel side planes, an axis aligned midway between said side planes, said comb further including a generally rectangular elongated backing member extending along the direction of said axis and perpendicular to said side planes, an array of identical vanes of generally rectangular shape, each said vane extending at right angles from said backing member and spaced along said axis, said vanes being of equal length and each terminating in an end forming a rectangular tip, each said rectangular tip of said vanes lying in a symmetry plane containing said axis and perpendicular to said side planes, a first and a second groove being formed on each said rectangular tip of said vanes, said first groove being centered on said axis and said second groove being centered on a line parallel to said axis, said vanes, backing member and opposed limiting surfaces defining therebetween an array of slots;

a second one-piece metallic comb having vanes, a backing member, a first and a second groove, slots, and a pair of opposed limiting surfaces which are the mirror image of said vanes, backing member, grooves, slots and opposed limiting surfaces of said first comb as mirrored in said symmetry plane;

said first and second combs being aligned on said symmetry plane such that the first vane grooves align to form an enclosed electron beam passageway, said a pair of opposed limiting surfaces of said second comb lying on said pair of parallel side planes of said first comb, said slots align to form an array of openings extending through said pair of limiting surfaces, and the second vane grooves align to form an axially extending channel communicating with each of said openings; and a pair of metallic cover members, each having a flat surface, said flat surface of each cover member covering and in electrical contact with a respective one of the pair of opposed limiting surfaces of said combs, said cover members being bonded to said combs in electrical contact therewith to cover and short circuit said openings to form an array of cavities coupled by said channel and to form part of a vacuum envelope for said circuit.

5. A coupled-cavity slow-wave circuit as in claim 4, in which said cover members have in addition planar surfaces perpendicular to said flat surfaces formed so that said cover members together fit tightly about said backing members.

* * * * *